US007354296B1

(12) United States Patent
Katwala et al.

(10) Patent No.: US 7,354,296 B1
(45) Date of Patent: Apr. 8, 2008

(54) CONTACT TERMINATION MEMBER FOR AN ELECTRICAL RECEPTACLE

(75) Inventors: Rajiv Katwala, Orange, CT (US); Yuan Fei, Chengdu (CN)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 11/524,525

(22) Filed: Sep. 21, 2006

(51) Int. Cl.
*H01R 4/24* (2006.01)
*H01R 4/26* (2006.01)
*H01R 11/20* (2006.01)

(52) U.S. Cl. ..... 439/441; 439/107

(58) Field of Classification Search ..... 439/107, 439/441, 535, 106
See application file for complete search history.

(56) References Cited

U.S. PATENT DOCUMENTS 2,705,785 A 4/1955 Benander
2,705,787 A 4/1955 Benander
2,762,023 A 9/1956 Williams
2,974,301 A 3/1961 Slater
3,001,168 A 9/1961 Smith
3,119,647 A * 1/1964 Flagg ..... 439/441
3,135,822 A 6/1964 Baran
3,185,760 A 5/1965 Despard
3,214,722 A 10/1965 Weimer, Jr.
3,255,428 A 6/1966 Robbins
3,325,768 A 6/1967 Munroe
3,339,170 A * 8/1967 Martin ..... 439/516
3,383,640 A 5/1968 Godziemba-Dambski
3,397,380 A 8/1968 Puig
3,467,941 A 9/1969 Martin
3,489,985 A 1/1970 Martin
3,579,283 A 5/1971 Welburn
3,609,642 A * 9/1971 Norden ..... 439/441
3,638,171 A 1/1972 Huilbrechtse
3,704,438 A 11/1972 Boone
3,944,314 A * 3/1976 Weitzman et al. ..... 439/411
3,967,873 A * 7/1976 Schumacher ..... 439/441
4,172,628 A * 10/1979 Lingaraju ..... 439/441
4,212,509 A 7/1980 Brooks
4,515,426 A 5/1985 Bager
4,566,748 A 1/1986 Tanishi
4,566,749 A 1/1986 Johnston
4,585,902 A 4/1986 Munroe
4,627,675 A 12/1986 Taylor
4,673,232 A 6/1987 Kubota
4,720,275 A 1/1988 Swart
4,772,218 A 9/1988 Ross
4,824,395 A 4/1989 Blaha
4,840,578 A 6/1989 Sato
4,854,898 A 8/1989 Turk
4,900,259 A 2/1990 Ludwig
4,904,203 A 2/1990 Wang
4,946,406 A 8/1990 Lane
4,952,167 A 8/1990 Hertelendy
5,015,201 A * 5/1991 Brezee et al. ..... 439/441

(Continued)

*Primary Examiner*—Hae M Hyeon
(74) *Attorney, Agent, or Firm*—Marcus R. Mickney; Mark S. Bicks; Alfred N. Goodman

(57) ABSTRACT

A contact termination member for an electrical receptacle is provided that electrically and mechanically secures an inserted wire to the electrical receptacle. The contact termination member has a base with a serrated portion. A spring arm connected to the base is adapted to bias the inserted wire against the serrated portion of the base to electrically and mechanically secure the inserted wire to the electrical receptacle.

26 Claims, 3 Drawing Sheets

U.S. PATENT DOCUMENTS 5,083,936 A 1/1992 Yang
5,110,305 A 5/1992 Edgley
5,149,279 A 9/1992 Kruse
5,320,558 A 6/1994 von Roretz
5,324,213 A 6/1994 Frantz
5,454,730 A 10/1995 Tozuka
5,484,306 A 1/1996 Mawby
5,695,369 A 12/1997 Swenson, Sr.
5,895,286 A * 4/1999 Linke ..... 439/441
5,957,729 A 9/1999 Federowicz
5,975,940 A 11/1999 Hartmann
6,010,347 A 1/2000 Lee
6,056,585 A 5/2000 Hatakeyama
6,146,217 A 11/2000 Osada
6,257,919 B1 7/2001 Cutler
6,280,233 B1 8/2001 Beege
6,315,578 B1 11/2001 Kasai
6,319,046 B1 11/2001 Feye-Hohmann
6,428,343 B1 8/2002 Landis
6,529,113 B2 3/2003 Endo
6,682,364 B2 1/2004 Cisey
6,695,638 B1 2/2004 David
6,722,914 B2 4/2004 Blaha
6,746,286 B2 6/2004 Blaha
6,796,830 B2 9/2004 Süss
6,814,608 B2 11/2004 Kollmann
6,857,894 B2 2/2005 Riku
6,860,752 B2 3/2005 McCoy
6,878,876 B2 * 4/2005 Brant et al. ..... 174/53
6,881,091 B2 4/2005 Brandl
6,926,543 B2 * 8/2005 Poh et al. ..... 439/107
2004/0053523 A1 3/2004 Berger
2004/0077210 A1 4/2004 Kollmann
2004/0235336 A1 11/2004 Brekosky
2004/0248457 A1 12/2004 Walter
2005/0042912 A1 2/2005 Drewes

* cited by examiner

CONTACT TERMINATION MEMBER FOR AN ELECTRICAL RECEPTACLE

FIELD OF THE INVENTION

The present invention relates to a contact termination member for an electrical receptacle. More particularly, the present invention relates to a contact termination member having a first spring arm adapted to retain an inserted wire against a serrated portion of a base of the contact termination member. Still more particularly, the present invention relates to a single unitary contact termination member having first and second spring arms extending in opposite directions and disposed proximal first and second openings in the base of an electrical receptacle, with the first and second spring arms being adapted to retain inserted wires against serrated portions of the base of the contact termination member.

BACKGROUND OF THE INVENTION

Electrical receptacles are typically installed in new commercial and residential construction projects in large quantities. Push-in wiring connections located on a rear surface of the electrical receptacle allow for quick and easy engagement of the wire with the electrical receptacle without having to use the tedious binding head screw terminal connections. The bared end of a wire is simply inserted through the opening in the rear surface of the electrical receptacle until it is gripped by an internal contact member. Conventional electrical receptacles typically use a single spring arm to retain the inserted wire within the electrical receptacle.

Furthermore, electrical receptacles are designed to accommodate safe and convenient circuit installation by homeowners who are not electricians and have little experience and background in electrical matters. Therefore, push-in wiring terminals need to be easy to use, while providing a safe and secure electrical and mechanical connection between the inserted wire and the electrical receptacle.

Since push-in wiring connections do not grip the wire as securely as binding head screw terminal connections, the push-in wiring connection may be disturbed as the wired receptacle is mounted in an electrical outlet box. Thus, a need exists for a contact termination member that securely retains an inserted wire within the electrical receptacle, while providing a quick and easy connection between the wire and electrical receptacle.

Another problem with push-in wiring connections is that the single spring arm is movable from outside the electrical receptacle to release an inserted wire. The spring arm may retain subsequently inserted wires less securely within the electrical receptacle after being deformed to release a previously inserted wire, thereby causing an unsafe electrical connection. This results in poor or failed electrical connections, which may cause a fire due to the poor connection. Thus, a need exists for a contact termination member that is not deformable from outside the electrical receptacle to release an inserted wire.

Conventional push-in wiring electrical receptacles are disclosed in U.S. Pat. Nos. 2,705,785 to Benander; 3,325,768 to Munroe; 3,489,985 to Martin; and 3,967,873 to Schumacher, the subject matters of which are hereby incorporated by reference in their entirety.

Thus, there is a continuing need to provide improved contact termination members for push-in wiring connections of electrical receptacles.

SUMMARY OF THE INVENTION

Accordingly, it is a primary objective of the present invention to provide an improved contact termination member for an electrical receptacle.

A further objective of the present invention is to provide an improved contact termination member having a first spring arm adapted to securely retain an inserted wire against a serrated portion of a base of the contact termination member.

A still further objective of the present invention is to provide a contact termination member in which first and second spring arms extend in substantially opposite directions and are adapted to retain first and second wires against first and second serrated portions of a base of the contact termination member.

Still another objective of the present invention is to provide a contact termination member in which the serrated portions are grooved to facilitate receiving, contacting and retaining an inserted wire.

The foregoing objectives are basically attained by a contact termination member for an electrical receptacle that electrically and mechanically secures an inserted wire to the electrical receptacle. The contact termination member has a base with a serrated portion. A spring arm connected to the base is adapted to bias the inserted wire against the serrated portion of the base to electrically and mechanically secure the inserted wire to the electrical receptacle.

The foregoing objectives may also be attained by a contact termination member for an electrical receptacle that electrically and mechanically secures first and second inserted wires to the electrical receptacle. The contact termination member has a base having first and second ends. A first leg extends from the first end of the base and has a first serrated portion. A second leg extends from the second end of the base and has a second serrated portion. A first spring arm connected to the base extends substantially parallel thereto and is adapted to bias a first inserted wire against the serrated portion of the first leg. A second spring arm connected to the base extends substantially parallel thereto in a direction substantially opposite to the first spring arm and is adapted to bias a second inserted wire against the second serrated portion of the second leg.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring now to the drawings that form a part of the original disclosure.

Throughout the drawings, like reference numerals will be understood to refer to like parts, components and structures.

DETAILED DESCRIPTION OF EXEMPLARY EMBODIMENTS

Figure 1:
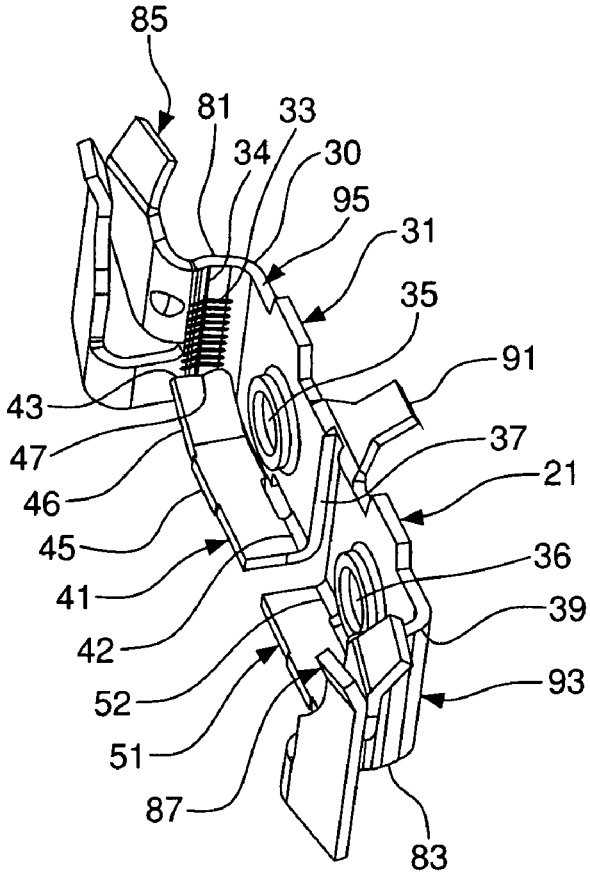
FIG. 1 is a perspective view of a contact termination member according to an exemplary embodiment of the present invention.

As shown in FIGS. 1-8, the present invention relates to a contact termination member 21 for an electrical receptacle 11. The contact termination member 21 has a base 31 with a first serrated portion 33. A first spring arm 41 connected to the base 31 is adapted to bias an inserted wire 17 against the first serrated portion 33 of the base 31 to electrically and mechanically secure the inserted wire to the electrical receptacle 11.

Figure 2:
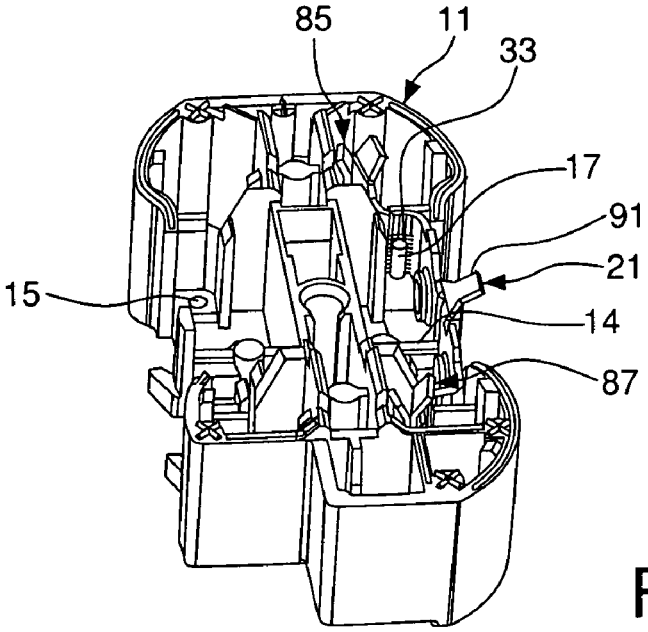
FIG. 2 is a perspective view of the contact termination member of FIG. 1 disposed in a base of an electrical receptacle and receiving an inserted wire.

The contact termination member 21 has a base 31 to which first and second spring arms 41 and 51 are connected. The base 31 has a first fastener hole 35 and a second fastener hole 36, which are preferably threaded and adapted to receive fasteners, such as screws 61 and 63, to electrically and mechanically secure a wire to the electrical receptacle 11 when the wire is not push-in terminated. A slot 37 extends upwardly from an edge 38 of the base 31 and is adapted to receive a mounting post 14 of the electrical receptacle 11 to facilitate disposing the contact termination member 21 in the electrical receptacle, as shown in FIG. 2.

Figure 4:
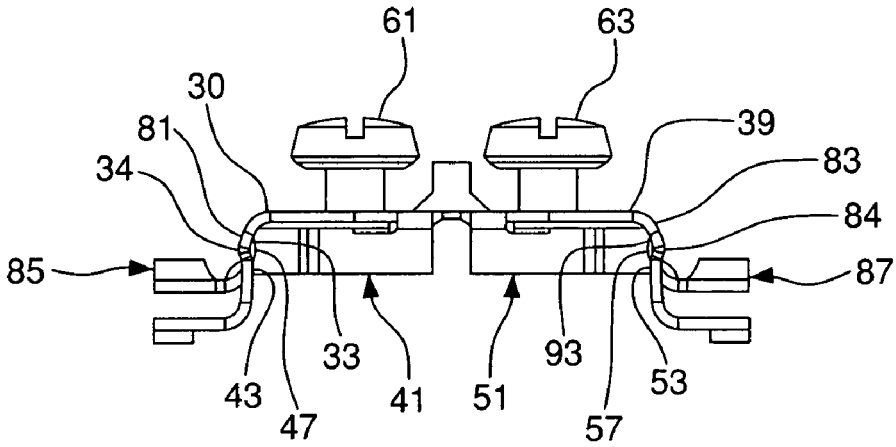
FIG. 4 is a top plan view of the contact termination member of FIG. 3.

The base 31 has a first end 30 and a second end 39, as shown in FIGS. 1 and 4. A first leg 81 extends substantially perpendicularly from the first end 30 of the base 31. A second leg 83 extends substantially perpendicularly from the second end 39 of the base 31. As shown in FIGS. 1, 4, 6 and 8, female contact ends 85 and 87 extend from the first and second legs 81 and 83, respectively. The female contact ends 85 and 87 are adapted to receive the male prongs of a plug (not shown) inserted in the electrical receptacle 11. The base may also form the conductive portion of an electrical receptacle. Furthermore, the tab 91 may be removed from the contact termination member 21, thereby forming separate first and second portions 93 and 95 that may be on different circuits. The mounting post 14 separates the first and second portions 93 and 95, thereby also separating the two circuits.

Figure 8:
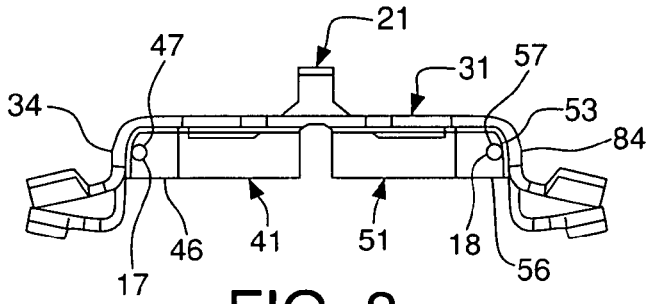
FIG. 8 is a top plan view of the contact termination member receiving an inserted wire of FIG. 6 removed from the electrical receptacle base.

An inner surface of the base 31 proximal the first leg 81 has a serrated portion 33 to facilitate retention of an inserted wire. Preferably, a groove 34 is formed lengthwise along the serrated portion 33 to further facilitate wire retention by increasing the contact area for an inserted wire. A second serrated portion 93 of the base 31 may be formed proximal an inner surface of the second leg 83, and is substantially similar to the first serrated portion 33. The second serrated portion may also have a second groove 84 to further facilitate retaining an inserted wire, as shown in FIG. 8. Preferably, the serrated portions and the grooves extend from a lower edge 92 to an upper edge 94 of the base 31.

Figure 6:
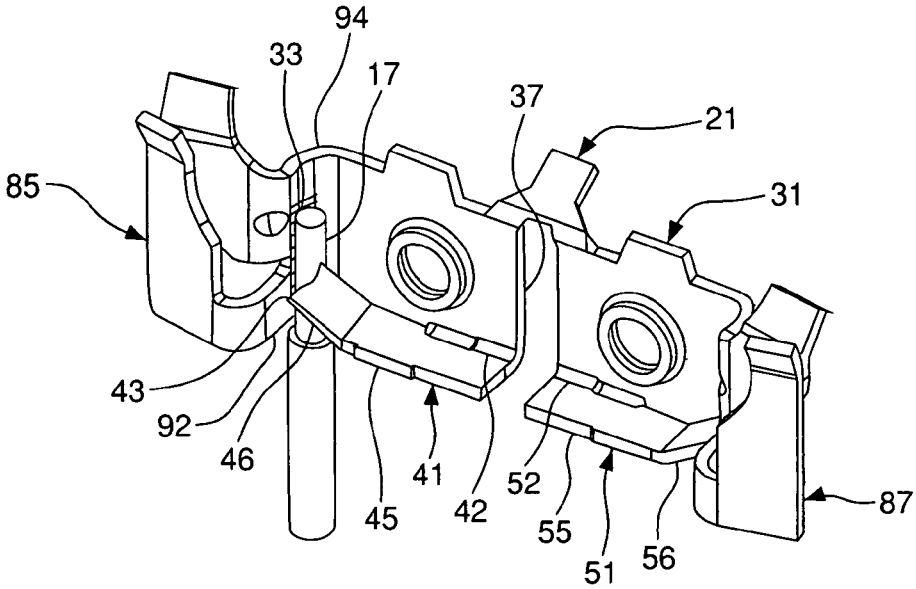
FIG. 6 is a perspective view of the contact termination member of FIG. 1 receiving an inserted wire.
Figure 7:
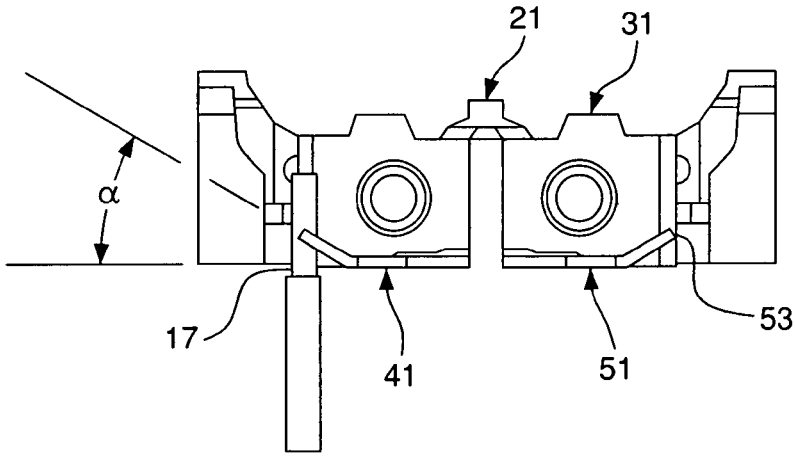
FIG. 7 is a front elevational view of the contact termination member receiving an inserted wire of FIG. 6.

A first spring arm 41 is connected to the base 31, as shown in FIGS. 1 and 6. Preferably, the first spring arm 41 is connected to the base 31 proximal the slot 37. As shown in FIGS. 1 and 6, a first connecting arm 42 connects the first spring arm 41 to the base 31. Preferably, the first spring arm 41 is substantially parallel to the base 31, as shown in FIGS. 4 and 8. The first spring arm 41 has a first portion 45 and a second portion 46. The first portion 45 is connected to the first connecting arm 42. The second portion 46 forms an angle $\alpha$ with the first portion 45 when not receiving a wire, as shown in FIG. 7. Preferably, the angle is approximately thirty degrees. When a wire 17 is inserted in an opening in the receptacle 11, the first spring arm 41 is adapted to move to a second position, as shown in FIGS. 2, 6 and 7.

The first spring arm 41 has a first free end 43 adapted to engage an inserted wire 17, as shown in FIG. 6. Preferably, the first free end 43 has a recess 47 to facilitate receiving a stripped portion of the wire 17.

A second spring arm 51 is connected to the base 31, as shown in FIGS. 1, 4 and 6-8. Preferably, the second spring arm is substantially similar to the first spring arm 41 but extending in a substantially opposite direction. Preferably, the second spring arm 51 is connected to the base 31 proximal the slot 37 and on an opposite side of the slot as the first spring arm 41, as shown in FIGS. 1, 4 and 6-8. A second connecting arm 52 connects the second spring arm 51 to the base 31. Preferably, the second spring arm 51 is substantially parallel to the base 31, as shown in FIGS. 4 and 8. The second spring arm 51 has a first portion 55 and a second portion 56. The first portion 55 is connected to the second connecting arm 52. The second portion 56 forms an angle with the first portion 55 when not receiving a wire (similar to the second portion 46 of the first spring arm 41), as shown in FIGS. 6 and 7. Preferably, the angle is approximately thirty degrees. When a wire 17 is inserted in an opening in the receptacle 11 proximal the second portion 56, the second spring arm 51 is adapted to move to a second position (similar to the first spring arm 41).

The second spring arm 51 has a second free end 53 adapted to engage an inserted wire 17, as shown in FIG. 8. Preferably, the second free end 53 has a recess 57 to facilitate receiving a stripped portion of the wire 17.

Figure 3:
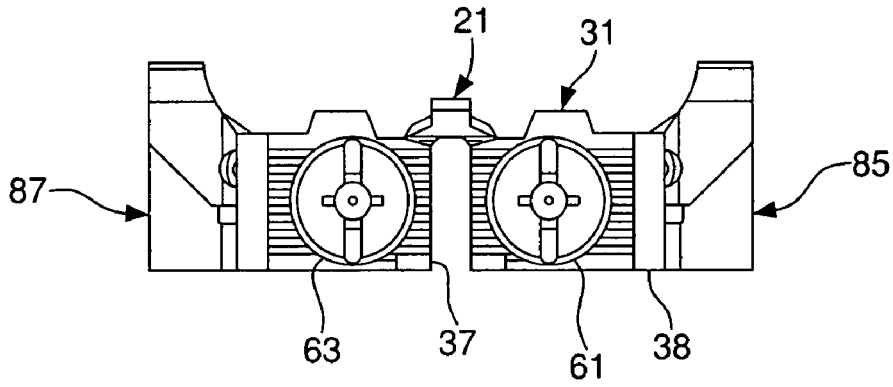
FIG. 3 is a rear elevational view of the contact termination member of FIG. 1 with fasteners adapted to receive wires that are not push-in terminated.
Figure 5:
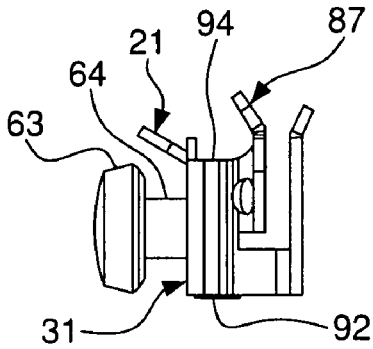
FIG. 5 is a side elevational view of the contact termination member of FIG. 3.

First and second fastener holes 35 and 36 in the base 31 are adapted to receive fasteners 61 and 63, as shown in FIGS. 3-5. The fasteners 61 and 63 provide an alternative means to electrically and mechanically secure wires to the electrical receptacle 11. A stripped end of a wire may be wrapped around a stem of the fastener (such as stem 64 of fastener 63 in FIG. 5), which is then threaded into the respective fastener hole such that the wire is secured between the fastener and the base 31 of the contact termination member 21, thereby electrically and mechanically terminating the wire.

A second contact termination member may be disposed in the lower portion of the electrical receptacle 11 in mirror image to termination member 21. The second contact termination member is substantially identical in structure and operation to the first contact termination member 21.

Preferably, the contact termination member 21 is unitarily formed as a single piece and made of a metal, such as brass.

ASSEMBLY AND DISASSEMBLY

The contact termination member 21 according to exemplary embodiments of the present invention is shown disposed in a lower portion of an electrical receptacle 11 in FIG. 2, and removed from the electrical receptacle in FIGS. 1 and 3-8.

A slot 37 extends upwardly from an edge 38 of the base 31 and is adapted to receive a mounting post 14 of the electrical receptacle 11 to facilitate securing the contact termination member 21 in the electrical receptacle. An upper portion (not shown) of the electrical receptacle is secured to a lower portion of the electrical receptacle 11 in any suitable manner, thereby securing the contact termination member within the electrical receptacle.

To mechanically and electrically terminate a wire, the wire 17 is inserted in an opening in the lower surface of the electrical receptacle 11, such as the opening 15 shown in FIG. 2. Preferably, there is an opening proximal the free end of each spring arm of each contact termination member disposed in the receptacle. The wire 17 passes through the opening 15, which is proximal the free end 43 of the first spring arm 41 and is substantially co-axially aligned with serrated groove 34. The wire 17 engages the free end 43 of the first spring arm 41. As the wire 17 is further inserted through the opening, the wire moves the first spring arm 41 to a second position, as shown in FIGS. 6 and 7. Preferably, the free end 43 of the first spring arm 41 has a recess 47 that engages the inserted wire, thereby increasing the contact area between the wire and first spring arm to more securely retain the wire within the electrical receptacle 11.

As the wire moves the first spring arm 41 from the first position (FIG. 1) to the second position (FIG. 6), the wire engages the serrated portion 33 of the base 31 of the contact termination member 21. The wire 17 is held against the serrated portion of the base 31 of the contact termination member 21 by the free end of the first spring arm 41. The serrated portion 33 of the base 31 increases friction between the inserted wire 17 and the base, thereby securely retaining the wire within the base. The serrated portion 33 may also remove oxidation on the wire 17 as the wire is inserted along the serrated portion, thereby improving contact therebetween. To further facilitate retaining the inserted wire in the receptacle, the serrated portion may have a groove 34 extending along the length of the serrated portion, as shown in FIG. 1, to increase the contact area between the base and the inserted wire. Preferably, there is no opening in the electrical receptacle 11 for insertion of a tool to release the inserted wire 17 from engagement with the free end of the first spring arm 51, as shown in the left side of FIG. 2 adjacent opening 15, thereby further facilitating retention of the inserted wire.

A second wire 18 inserted in another opening in the receptacle 11 is mechanically and electrically secured within the electrical receptacle by the second spring arm 51 in a substantially similar manner. Wires inserted in other openings (FIG. 2) are mechanically and electrically secured within the electrical receptacle 11 by a second contact termination member in a manner substantially similar to that of the first contact termination member 21.

While advantageous embodiments have been chosen to illustrate the invention, it will be understood by those skilled in the art that various changes and modifications may be made therein without departing from the scope of the invention as defined in the appended claims.

What is claimed is:

1. A contact termination member for an electrical receptacle, comprising:

a base having a serrated portion and a wire entry portion through which a wire is inserted; and a spring arm integrally formed with said base to bias the inserted wire against said serrated portion of said base, a free end of said spring arm being proximal said wire entry portion of said base.

2. The contact termination member for the electrical receptacle according to claim 1, wherein said serrated portion extends from a first edge to a second edge of said base.

3. The contact termination member for the electrical receptacle according to claim 1, wherein a groove extends along a length of said serrated portion.

4. The contact termination member for the electrical receptacle according to claim 1, wherein said spring arm has a recess at said free end to receive the inserted wire.

5. The contact termination member for the electrical receptacle according to claim 1, wherein said spring arm has a second portion formed at an angle to a first portion when not retaining the inserted wire.

6. The contact termination member for the electrical receptacle according to claim 5, wherein said angle is approximately thirty degrees.

7. The contact termination member for the electrical receptacle according to claim 1, wherein said contact termination member is disposed in an insulated electrical receptacle housing.

8. The contact termination member for the electrical receptacle according to claim 7, wherein said electrical receptacle housing does not have an opening to release said inserted wire from said spring arm.

9. A contact termination member for an electrical receptacle, comprising:

a base having a first end and a second end and a first wire entry portion for receiving a first inserted wire;

a first leg extending from said first end of said base, said first leg having a first serrated portion;

a first spring arm connected to said base and extending substantially parallel to said base to bias the first inserted wire against said serrated portion of said first leg, a first free end of said first spring arm being proximal said first wire entry portion of said base.

10. The contact termination member for the electrical receptacle according to claim 9, wherein said contact termination member is unitarily formed as a single piece.

11. The contact termination member for the electrical receptacle according to claim 9, wherein said first serrated portion has a first groove to receive the first wire.

12. The contact termination member for the electrical receptacle according to claim 9, wherein said first free end of said first spring arm has a first recess to receive the first wire.

13. The contact termination member for the electrical receptacle according to claim 9, wherein said base has a second leg extending from said second end of said base and a second wire entry portion for receiving a second inserted wire, said second leg having a second serrated portion; and a second spring arm connected to said base and extending substantially parallel to said base to bias the second inserted wire against said second serrated portion of said second leg.

14. The contact termination member for the electrical receptacle according to claim 13, wherein said first and second spring arms are integrally formed with said base as a single piece.

15. The contact termination member for the electrical receptacle according to claim 13, wherein said base has first and second fastener holes receiving first and second fasteners, respectively, to secure the first and second wires.

16. The contact termination member for the electrical receptacle according to claim 13, wherein first and second female contact ends extend outwardly from each of said first and second legs, respectively, to receive prongs of a plug inserted into said electrical receptacle.

17. The contact termination member for the electrical receptacle according to claim 13, wherein each of said first and second spring arms has a second portion formed at an angle to a first portion when not retaining the first and second inserted wires.

18. The contact termination member for the electrical receptacle according to claim 17, wherein said angle is approximately thirty degrees.

19. The contact termination member for the electrical receptacle according to claim 14, wherein said contact termination member is disposed in an insulated electrical receptacle housing.

20. The contact termination member for the electrical receptacle according to claim 19, wherein said electrical receptacle housing does not have openings to release the first and second inserted wires from said first and second spring arms, respectively.

21. A contact termination member for an electrical receptacle, comprising:

a base having a first end and a second end and first and second wire entry portions for receiving first and second inserted wires;

a first leg extending from said first end of said base, said first leg having a first serrated portion;

a second leg extending from said second end of said base, said second leg having a second serrated portion;

a first spring arm connected to said base and extending substantially parallel to said base to bias the first inserted wire against said first serrated portion of said first leg; and a second spring arm connected to said base and extending substantially parallel to said base and in a direction substantially opposite to said first spring arm to bias the second inserted wire against said second serrated portion of said second leg.

22. The contact termination member for the electrical receptacle according to claim 21, wherein first and second female contact ends extend outwardly from said first and second legs, respectively, to receive prongs of plugs inserted into said electrical receptacle.

23. The contact termination member for the electrical receptacle according to claim 21, wherein first and second grooves extend along said first and second serrated portions, respectively, to receive the first and second wires.

24. The contact termination member for the electrical receptacle according to claim 21, wherein first and second free ends of said first and second spring arms have first and second recesses, respectively, to receive the first and second wires.

25. The contact termination member for the electrical receptacle according to claim 21, wherein said contact termination member is disposed in an insulated electrical receptacle housing.

26. The contact termination member for the electrical receptacle according to claim 25, wherein said electrical receptacle housing does not have an opening to release an inserted wire from said spring arm.

* * * * *